US006000058A

United States Patent [19]

Iselin

[11] Patent Number: 6,000,058

[45] Date of Patent: Dec. 14, 1999

[54] BEVERAGE-HOLDING DEVICE

[76] Inventor: Charles P. Iselin, 1603 15th St., Oregon City, Oreg. 97045

[21] Appl. No.: 09/222,037

[22] Filed: Dec. 29, 1998

[51] Int. Cl.[6] ..... A41D 19/00

[52] U.S. Cl. ..... 2/160; 224/148.1; 224/219; 224/901.8

[58] Field of Search ..... 2/159, 160, 161.1, 2/161.6, 166, 300; 220/915.1, 915.2, 592.16, 592.2, 592.24; 224/148.1, 148.5, 148.6, 217, 218, 251, 219, 148.4, 660, 901.2, 901.6, 901.8

[56] References Cited

U.S. PATENT DOCUMENTS

| | | | |
|---|---|---|---|
| D. 289,721 | 5/1987 | Havis . | |
| 1,640,004 | 8/1927 | Lundblad . | |
| 2,223,029 | 11/1940 | Dunton | 2/160 |
| 2,432,325 | 12/1947 | McDougall | 2/160 |
| 2,902,693 | 9/1959 | Wells, Jr. . | |
| 4,247,097 | 1/1981 | Schwartz . | |
| 4,326,706 | 4/1982 | Guthrie et al. . | |
| 4,414,692 | 11/1983 | Dzierson et al. . | |
| 4,789,073 | 12/1988 | Fine | 215/13.1 |
| 4,793,005 | 12/1988 | Hetzel, Jr. . | |
| 5,003,637 | 4/1991 | Lonon . | |
| 5,088,121 | 2/1992 | Wallace . | |
| 5,276,922 | 1/1994 | Floyd, Jr. . | |
| 5,277,733 | 1/1994 | Effertz | 156/215 |
| 5,381,922 | 1/1995 | Gladman et al. | 220/481 |
| 5,706,521 | 1/1998 | Haney . | |

*Primary Examiner*—Diana Oleksa
*Assistant Examiner*—Katherine Moran
*Attorney, Agent, or Firm*—Kolisch, Hartwell, Dickinson, McCormack & Heuser

[57] ABSTRACT

A beverage-holding device is disclosed. The device includes a beverage holder coupled to a glove. The beverage holder is adapted to receive and support a beverage container, and is coupled to the glove by one or more fastening mechanisms, which may be fixed or selectively releasable mechanisms. In some embodiments of the invention, the holder is pivotally coupled to the glove. When not being used to support a beverage container, the holder may be stowed in an out-of-the-way position, such as on the back of the glove.

27 Claims, 3 Drawing Sheets

BEVERAGE-HOLDING DEVICE

FIELD OF THE INVENTION

The invention relates generally to drinking apparatus, and more particularly to a combination glove and beverage holder.

BACKGROUND AND SUMMARY OF THE INVENTION

When holding a beverage, one must be careful to maintain a firm, stable grip on the beverage to prevent dropping or spilling the beverage. When the beverage is hot or cold, this may be more difficult because the heat or cold from the beverage may be conducted through the beverage container to the user's hand. One method for preventing this heat conduction, as well as change of the beverage's temperature due to exposure to the ambient environment, is to support the beverage in a beverage holder, which may be insulated. However, use of such a holder still requires a user to maintain a firm grip on the holder and to store the holder when not currently being used.

One solution to this problem is disclosed in U.S. Pat. No. 4,414,692 to Dzierson et al., in which a glove with a detachable beverage holder is disclosed. The disclosure of Dzierson et al. is hereby incorporated by reference. In Dzierson et al., the beverage holder is secured to the glove in a defined position by a hook and loop closure mechanism extending along the length of the beverage holder. The glove further includes a snap fastener to prevent the weight of a beverage in the holder from causing the holder to be unintentionally detached from the glove. When not mounted on the palm region of the glove, the beverage holder must be stored elsewhere by the user, which is inconvenient and can easily lead to the holder being misplaced.

The invented device is a combination glove and beverage holder. Unlike the device of Dzierson et al., however, in one embodiment of the invention the holder is selectively positionable between a use position in which the holder is proximate the palm region of the glove for receiving a beverage and being gripped by the user, and a stowed position, in which the holder is retained in an out-of-the-way position, such as on the back of the glove. In other embodiments, the holder is pivotally coupled to the glove, thereby enabling the holder to be pivoted between the above positions and/or to remain in a generally vertical orientation even when the glove is not.

Many other features of the present invention will become manifest to those versed in the art upon making reference to the detailed description which follows and the accompanying sheets of drawings in which preferred embodiments incorporating the principles of this invention are disclosed as illustrative examples only.

DETAILED DESCRIPTION OF THE INVENTION

Figure 1:
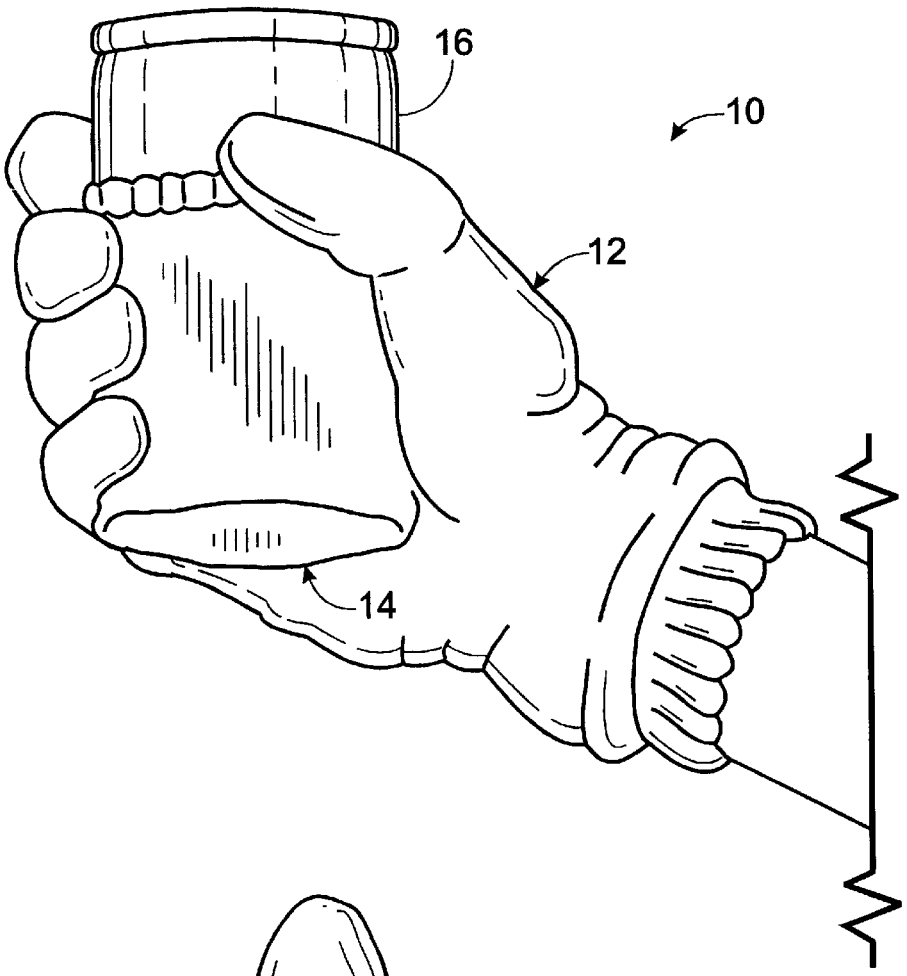
FIG. 1 is a side elevation view of a glove and beverage holding device constructed according to the present invention.

A glove and beverage holding device constructed according to the present invention is shown in FIG. 1 and generally indicated at 10. Device 10 includes a glove 12 and a beverage holder, or receptacle, 14. Holder 14 is coupled to glove 12 and is adapted to receive and support a beverage container, such as can 16 shown in FIG. 1, but also including bottled and boxed beverages, cups and the like.

Figure 2:
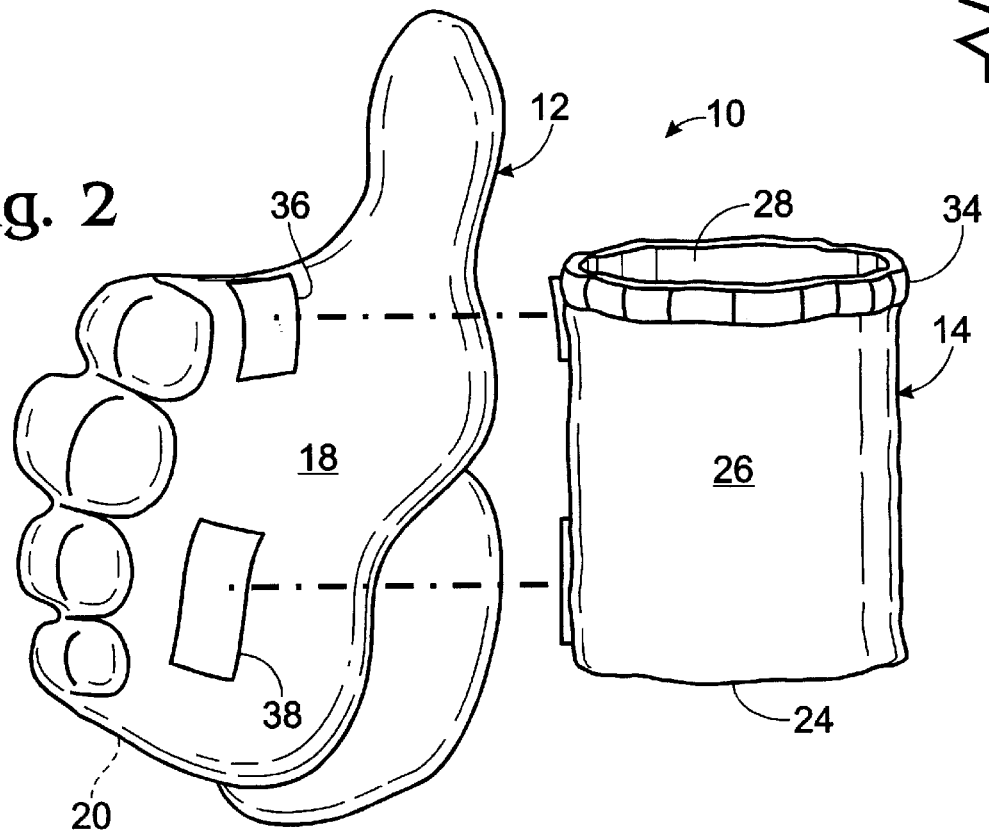
FIG. 2 is an exploded view of the device of FIG. 1, showing first and second fastening mechanisms adapted to couple the beverage holder to the glove.

As perhaps shown in FIG. 2, glove 12 includes a palm region 18 and a back, or rear, region 20, with the palm region adapted to extend across the palm of a user's hand and the back region adapted to extend across the region of the hand generally opposed to the palm. Glove 12 may also include a message-displaying region 22 on back region 20 for displaying a message to viewers, such as shown schematically in FIG. 4.

In the Figures, glove 12 is adapted to be worn on the user's right hand. It is within the scope of the present invention that device 10 may include a left-hand embodiment as well, with the left-hand embodiment being the mirror image of the glove shown in the Figures. As used herein, the term "glove" is meant to include any form of hand covering, including without limitation conventional closed-fingered gloves (FIG. 1), mittens (FIG. 3), open fingered gloves (FIG. 4), and the like. Glove 12 may be formed of any suitable material and may be of any known configuration for wearing on a user's hand. In FIG. 1, glove 12 is a winter glove, in that it is insulated to keep the user's hand warm. Instead of the insulated material shown in FIG. 1, glove 12 may be formed of more light-weight and/or breathable materials for use in warmer environments.

Figure 3:
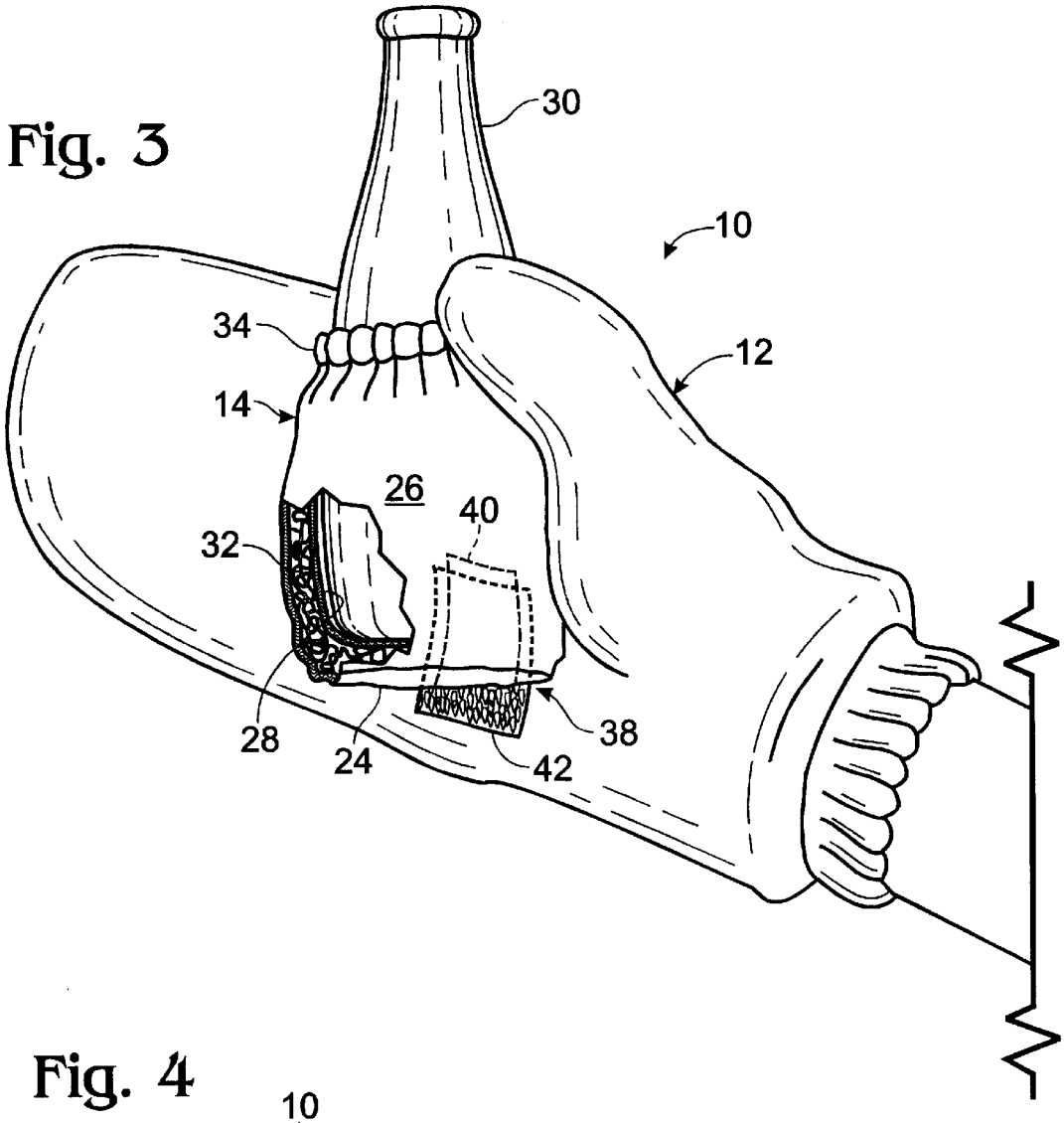
FIG. 3 is a side elevation view of the device of FIG. 1, with the glove being a mitten and the beverage holder shown partially broken away and holding a bottle.

As perhaps best seen in FIGS. 2 and 3, beverage holder 14 includes a base 24 and a sleeve 26 extending away from the base. Sleeve 26 defines a cavity 28 that is adapted to receive at least a substantial portion of a beverage container, such as can 16 in FIG. 1 or bottle 30 in FIG. 3. In the embodiment of holder 14 shown in FIG. 3, it can be seen that the holder includes a layer of insulating material 32 to keep hot beverages hot, cold beverages cold, and to limit the conduction of heat and cold between a beverage container received within the holder and one or more of the user's hands and the surrounding environment. Any known insulating material may be used.

Spaced-apart from base 24, holder 14 includes a collar 34, which in FIGS. 2 and 3 is shown near the opening of cavity 28. Collar 34 is elastomeric and enables beverage holder 14 to selectively stretch or contract to conform to the shape of the beverage container received therein, regardless of whether the beverage container is a can, bottle, boxed drink, drinking glass, tapered glass, etc. Once positioned within cavity 28, a beverage container is supported by holder 14 and retained therein. It is within the scope of the present invention that more than just the collar of the beverage holder may be formed of an elastomeric material.

Holder 14 is coupled to glove 12 by at least one fastening, or attachment, mechanism. In FIG. 2, a pair of fastening mechanisms 36 and 38 are schematically illustrated in a spaced-apart relationship to each other. It is within the scope of the present invention that the fastening mechanisms may be any suitable form of mechanical attachment, including snap mechanisms, hook and loop closure mechanisms, clips, buttons, stitches, brads, etc. Also, the number of fastening mechanisms may vary between a single mechanism, a pair of mechanisms, or more, and device 10 may include more than a single type of fastening mechanism. As shown schematically in FIG. 2, each mechanism includes a pair of portions that are selectively coupled together at attachment regions to releasably or fixedly secure the holder and glove together.

In some embodiments of the invention described herein, it is desirable to have a fastening mechanism that is specifically fixed or selectively releasable. By "fixed," it is meant that the fastening mechanism cannot release the holder from the glove without destruction of at least a portion of the glove, holder or fastening mechanism. Examples of fixed fastening mechanisms include stitches, rivets, and a continuous length of material forming a part of the glove and the holder. On the other hand, by "selectively releasable" it is meant that the fastening mechanism enables the holder to be selectively removed from the glove and reattached thereto without destruction of any portion of the glove, holder or fastening mechanism. Examples of selectively releasable fastening mechanisms include hook and loop (Velcro®) mechanisms, buttons and snaps. It should be understood that the examples given above were presented to provide illustrative examples of these terms and should not be construed to be an exhaustive or complete list. Instead, the examples should provide guidelines for identifying and classifying suitable fastening mechanisms. It is within the scope of the present invention that the schematically illustrated fastening mechanisms 36 and 38 could be either fixed or selectively releasable fastening mechanisms.

In FIG. 3, mechanism 38 is a selectively releasable fastening mechanism, namely, a hook and loop (Velcro®) closure mechanism. Mechanism 38 includes a first portion 40 mounted on holder 14, and a second portion 42 mounted on glove 12 and positioned to engage first portion 40 when the holder is in contact with palm region 18. As shown, portion 40 extends along at least a portion of sleeve 26. However, other mounting positions are possible as long as there is a corresponding mounting position on glove 12 so that the portions can be selectively engaged to retain the holder against the palm region of the glove. For example, the first portion may extend generally downwardly from holder 14 and be adapted to either directly engage corresponding portion 42 in this position, or when folded back upon sleeve 26.

Figure 4:
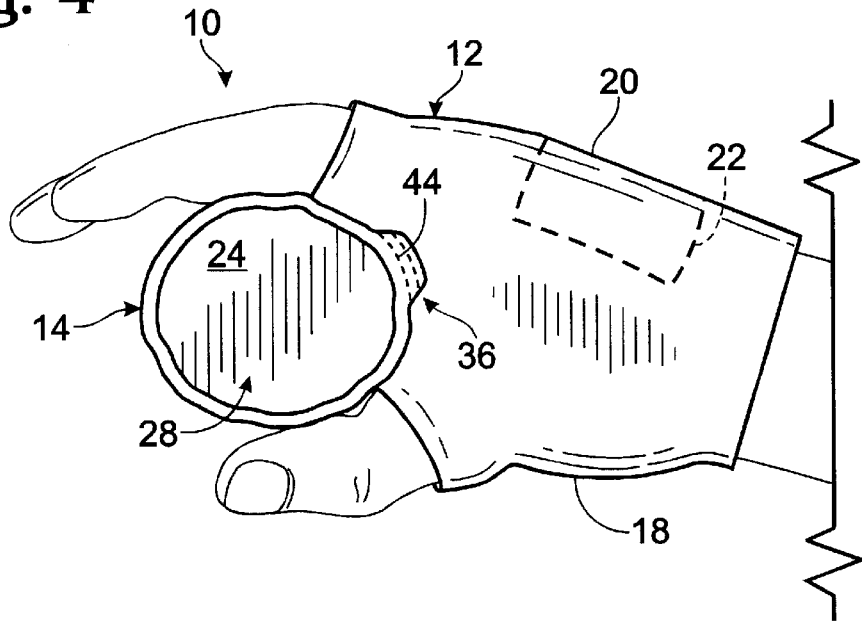
FIG. 4 is a top plan view of the device of FIG. 1 with no beverage in the beverage holder and the glove being an open-fingered glove.

In FIG. 4, fastening mechanism 36 is a fixed fastening mechanism, namely, stitches 44. A benefit of a fixed fastening mechanism is that holder 14 will not be inadvertently detached from glove 12, such as when supporting a relatively heavy beverage, when the user makes a sudden movement with the hand on which device 10 is worn, or if the beverage or holder is struck by an object or person. Also, by having a fastening mechanism that will not inadvertently be detached from the glove, the user does not need to maintain a firm or even any, grip on holder 14. Instead, holder 14 is maintained proximate the palm region of the glove, even if the user's fingers do not extend around the holder, such as shown in FIG. 3.

Figure 5:
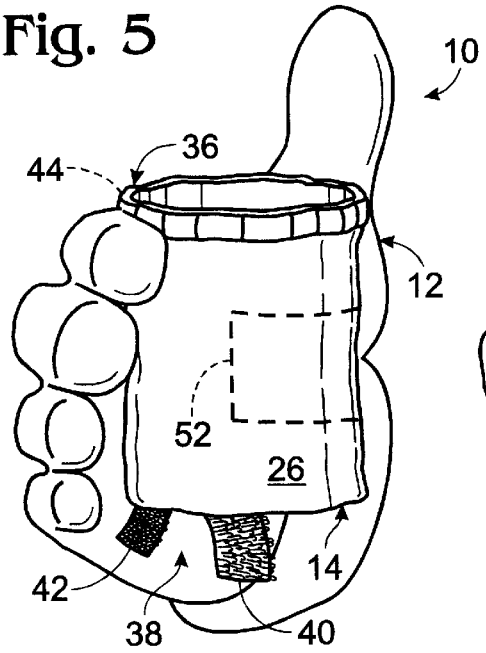
FIG. 5 is a front elevation view of the device of FIG. 1 with the beverage holder in a use position.
Figure 6:
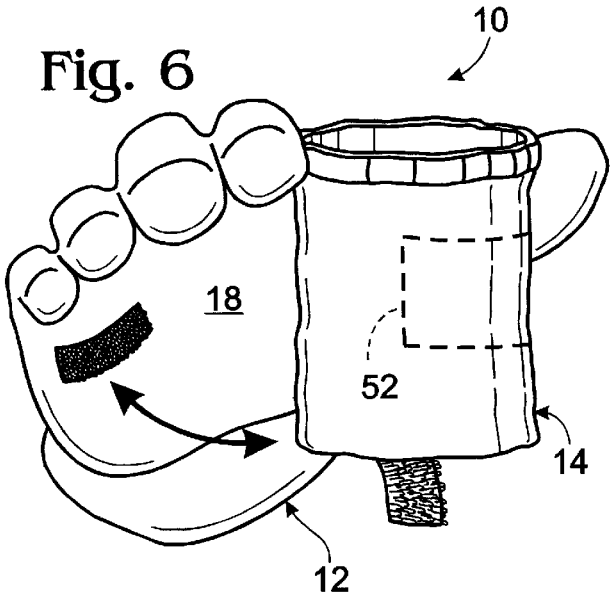
FIG. 6 is a front elevation view of the device of FIG. 5 with the beverage holder pivoted away from the glove to retain a substantially vertical orientation when the glove is inclined with respect to the holder.

Preferably, mechanism 36 enables pivotal movement of holder 14 with respect to glove 12. For example, in FIG. 5, holder 14 is shown pivotally coupled to glove 12 with fastening mechanism 36, such as stitches 44. Fastening mechanism 38 is shown in a released position, in which portions 40 and 42 are not in engagement with each other. From this position, the user may incline or otherwise tilt the hand on which glove 12 is worn without similarly moving holder 14 and any inserted beverage, as shown in FIG. 6. Instead, the pivotal mechanism enables the holder to remain in a substantially upright, or vertical, position even though the palm and back regions of the glove extend in a horizontal or inclined position. This feature is also helpful if the user needs to use the hand on which device 10 is mounted. A device with such a fastening mechanism may also be described as including a hinge structure adapted to permit pivotal movement of the holder with respect to the glove. This hinge structure may also be described as a bilaterally positional hinge mechanism.

Figure 7:
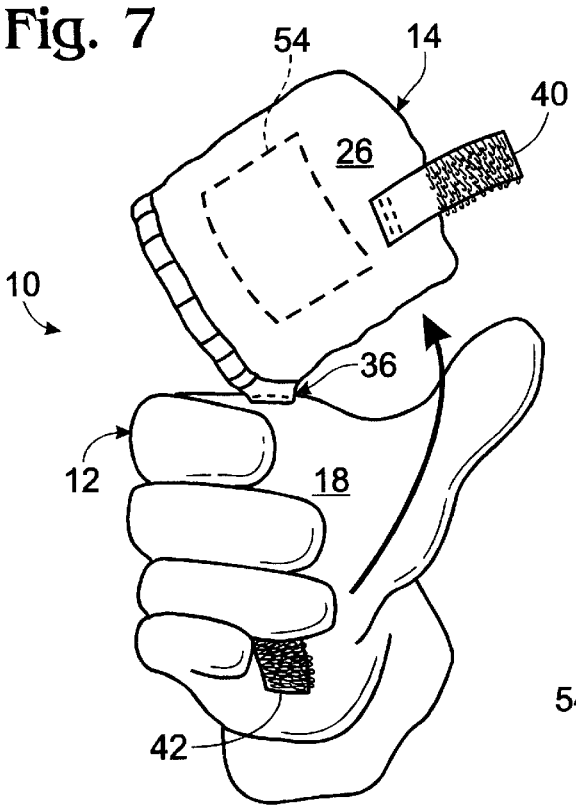
FIG. 7 is a front elevation view of the device of FIG. 5 with the beverage holder pivoted toward a stowed position.
Figure 8:
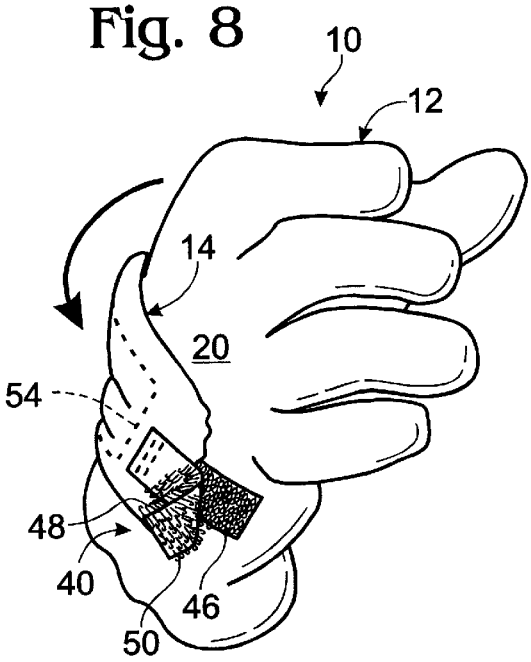
FIG. 8 is a front elevation view of the device of FIG. 5 with the beverage holder in a stowed position.

Having a fastening mechanism that enables pivotal movement of holder 14 with respect to glove 12 also enables the holder to be selectively stowed in an out-of-the-way position on the back region of the glove. For example, in FIG. 5, holder 14 is shown in a use position, in which the holder is on the palm side of the glove. In this position, the holder may be selectively gripped by the user, and the palm region of glove 12 is generally between the back region and the sleeve. From this use position, holder 14 may be pivoted to the intermediate position shown in FIG. 7, and then further pivoted to the stowed position shown in FIG. 8, where the holder is at least substantially collapsed to lie relatively flush with back region 20 of the glove. In the stowed position, the back region is generally between the palm region and the sleeve. As shown in FIG. 8, back region 20 includes a portion 46 of a fastening mechanism adapted to engage first portion 40 on holder 14 and thereby selectively retain the holder in the stowed position. As shown, portion 46 cooperates with portion 40 to form a hook and loop closure mechanism. As perhaps best seen in FIGS. 7 and 8, portion 40 is a double-sided portion of a hook and loop closure mechanism, with a pair of sides 48 and 50, adapted to respectively engage portions 40 and 46.

As discussed above, other fastening mechanisms are possible. For example, portion 40 may be a single-sided portion of a hook and loop closure mechanism with an operative portion that normally faces away from portion 42 on glove 12. When the user wants to prevent the holder from pivoting with respect to the glove, the portion may be folded back toward sleeve 26 so that its operative surface faces portion 42 on glove 12. A similar configuration may be used with other selectively releasable fastening mechanisms, such as buttons, snaps, etc.

If holder 14 is retained in the use position by a fastening mechanism other than the mechanism that enables the pivotal movement of the holder, such as mechanism 38 in FIGS. 2 and 3, then that mechanism needs to be selectively released prior to pivoting the holder toward the stowed position.

Holder 14 may further include at least one message-displaying region on sleeve 26. This region enables an advertising or other message to be displayed to viewers when device 10 is used. For example, the message may include trademarks, logos, images, sayings, slogans or other identifying or personal indicia of products, teams, organizations, schools, individuals, etc.

By referring back to FIGS. 5 and 6, it can be seen that sleeve 26 may include a message-displaying region 52 that presents a message to viewers when the holder is in its use position. Additionally, or alternatively, sleeve 26 may also have a message-displaying region 54, such as shown in FIGS. 7 and 8, that presents a message to viewers when holder 14 is in its stowed position. When holder 14 includes both regions 52 and 54, the first is visible when the holder is used to support a beverage, while the second is visible when the holder is stowed on the back region of the glove. Both regions 52 and 54 are illustrated schematically in the Figures to generally indicate a region on the sleeve where a message may be attached, stitched or otherwise added to the sleeve.

It should be understood that it is within the scope of the present invention that all fastening mechanisms are selectively releasable mechanisms. If at least one mechanism enables pivotal movement of holder 14, then holder 14 may be stowed as described above. If not, or alternatively, holder 14 may be detached from glove 12 by selectively releasing any fastening mechanisms, then stowing the holder apart from the glove or elsewhere on the glove, such as on back region 20. When stowed elsewhere on the glove, it should be understood that glove 12 should include portions of the fastening mechanisms that correspond and are adapted to selectively engage the portions on holder 14.

As discussed above, device 10 may be constructed with either right- or left-handed gloves. In many applications, especially in cold weather applications, it is desirable to have a pair of gloves, one for each of a user's hands. Because a user will not necessarily need two beverage holders, it is possible to wear a pair of gloves 12 and interchangeably couple a holder 14 on either glove, depending on the user's preferred hand for drinking, conditions that favor use of one hand over the other, etc. If it is desirable to move the holder to the other glove, it may be detached from the current glove by selectively releasing the fastening mechanism(s) and then reattached to the other glove. Of course, this option is reserved for embodiments of device 10 in which holder 14 is selectively releasable. When a fixed holder is used, then each glove may have a holder attached. Because the holders are stowable in an out-of-the-way position on the glove, however, the user will not be encumbered by having a pair of beverage holders at all times positioned for gripping by each of the user's hands. Instead one or both of the holders may be stowed, thereby freeing one or both of the user's hands to do other activities.

The invented device may further include additional pockets and accessories, such as disclosed in U.S. Pat. Nos. 5,276,922 and 5,003,637, the disclosures of which are hereby incorporated by reference.

The foregoing description of the preferred embodiments of the invention has been presented for purposes of illustration and description. It is not intended to be exhaustive or to limit the invention to the precise form disclosed, and many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. A beverage-holding device, comprising:

a glove having a palm region and a back region generally opposed to the palm region;

a beverage receptacle coupled to the glove and adapted to receive a beverage container, wherein the receptacle includes a base and a sleeve extending from the base to define a cavity into which the container may be at least partially received, and further wherein the receptacle is selectively positionable between a first position, in which the palm region is generally between the back region and the sleeve, and a stowed position, in which the back region is generally between the palm region and the sleeve and;

an attachment mechanism including a portion extending away from the base of the receptacle and adapted to selectively retain the beverage receptacle in the stowed position.

2. The device of claim 1, wherein the receptacle is coupled to the glove with a fastening mechanism, and the fastening mechanism is selectively releasable to enable the receptacle to be removed from the glove and recoupled thereto.

3. The device of claim 1, wherein the receptacle is coupled to the glove with a fastening mechanism, and the fastening mechanism is a fixed fastening mechanism.

4. The device of claim 1, wherein the cavity is closed when the receptacle is in the stowed position.

5. The device of claim 1, wherein the receptacle is at least substantially collapsed when in the stowed position.

6. The device of claim 1, wherein the receptacle is pivotally coupled to the glove.

7. The device of claim 1, wherein the receptacle includes a collar distal the base, and further wherein the collar includes a fastening mechanism coupling the receptacle to the glove.

8. A beverage holding device, comprising:

a glove having a palm region and a back region generally opposed to the palm region; and a beverage receptacle adapted to receive a beverage container, wherein the receptacle is fixedly coupled to the glove by at least one fixed fastening mechanism adapted to prevent removal of the receptacle from the glove without destruction of at least a portion of the glove, the receptacle or the at least one fastening mechanism.

9. The device of claim 8, wherein the receptacle is selectively positionable between a first position, in which the sleeve is proximate the palm region, and a stowed position, in which the sleeve is proximate the back region.

10. The device of claim 8, wherein the receptacle is selectively positionable between a first position, in which the sleeve is at least substantially in contact with the palm region, and a stowed position, in which the sleeve is at least substantially in contact with the back region.

11. A beverage-holding device, comprising:

a glove having a palm region and a back region generally opposed to the palm region; and a beverage holder adapted to receive a beverage container, wherein the holder includes a base and a sleeve extending from the base to define a cavity into which the container may be at least partially received;

a hinge structure pivotally coupling the holder to the glove, wherein the hinge suture is bilaterally positionable to enable selective positioning of the holder between a first position, in which the palm region of the glove is generally between the sleeve and the back region, and a second position, in which the back region of the glove is generally between the sleeve and the palm region; and an attachment mechanism adapted to selectively retain the beverage holder in the second position.

12. The device of claim 11, wherein the holder is adapted to be at least substantially collapsed when in the second position.

13. The device of claim 11, wherein the device further includes a second fastening mechanism spaced-apart from the hinge structure and adapted to secure the holder to the palm region of the glove.

14. The device of claim 11, wherein the beverage holder includes a base and at least a portion of the fastening mechanism extends from the base and is adapted to selectively engage the glove to retain the beverage holder thereupon.

15. A beverage-holding device, comprising:

a glove having a palm region and a back region generally opposed to the palm region;

a beverage receptacle coupled to the glove and adapted to receive a beverage container, wherein the receptacle includes a base and a sleeve extending from the base to define a cavity into which the container may be at least partially received, and wherein the receptacle is selectively positionable between a first position, in which the palm region is generally between the back region and the sleeve, and a stowed position, in which the back region is generally between the palm region and the sleeve, and further wherein the receptacle is closed when in the stowed position.

16. The beverage holding device of claim 15, further including an attachment mechanism adapted to selectively retain the beverage receptacle in the stowed position.

17. The beverage holding device of claim 15, wherein the receptacle is coupled to the glove with a fastening mechanism, and the fastening mechanism is selectively releasable to enable the receptacle to be removed from the glove and recoupled thereto.

18. The beverage holding device of claim 15, wherein the receptacle is coupled to the glove with a fastening mechanism, and the fastening mechanism includes a fixed fastening mechanism.

19. A beverage-holding device, comprising:

a glove having a palm region and a back region generally opposed to the palm region;

a beverage receptacle coupled to the glove and adapted to receive a beverage container, wherein the receptacle includes a base and a sleeve extending from the base to define a cavity into which the container may be at least partially received, and wherein the receptacle is selectively positionable between a first position, in which the palm region is generally between the back region and the sleeve, and a stowed position, in which the back region is generally between the palm region and the sleeve, and further wherein the receptacle is at least substantially collapsed when in the stowed position.

20. The beverage holding device of claim 19, further including an attachment mechanism adapted to selectively retain the beverage receptacle in the stowed position.

21. The beverage holding device of claim 19, wherein the receptacle is coupled to the glove with a fastening mechanism, and the fastening mechanism is selectively releasable to enable the receptacle to be removed from the glove and recoupled thereto.

22. The beverage holding device of claim 19, wherein the receptacle is coupled to the glove wit a fastening mechanism, and the fastening mechanism includes a fixed fastening mechanism.

23. A beverage-holding device, comprising:

a glove having a palm region and a back region generally opposed to the palm region;

a beverage receptacle coupled to the glove and adapted to receive a beverage container, wherein the receptacle includes a base and a sleeve extending from the base to define a cavity into which the container may be at least partially received, and wherein the receptacle is selectively positionable between a first position, in which the palm region is generally between the back region and the sleeve, and a stowed position, in which the back region is generally between the palm region and the sleeve, and further wherein the receptacle is pivotally coupled to the glove.

24. The beverage holding device of claim 23, further including an attachment mechanism adapted to selectively retain the beverage receptacle in the stowed position.

25. The beverage holding device of claim 23, wherein the receptacle is coupled to the glove with a fastening mechanism, and the fastening mechanism is selectively releasable to enable the receptacle to be removed from the glove and recoupled thereto.

26. The beverage holding device of claim 23, wherein the receptacle is coupled to the glove with a fastening mechanism, and the fastening mechanism includes a fixed fastening mechanism.

27. A beverage-holding device, comprising:

a glove having a palm region and a back region generally opposed to the palm region;

a beverage holder adapted to receive a beverage container, wherein the holder includes a base and a sleeve extending from the base to define a cavity into which the container may be at least partially received; and a hinge structure pivotally coupling the holder to the glove, wherein the hinge structure is bilaterally positionable to enable selective positioning of the holder between a first position, in which the palm region of the glove is generally between the sleeve and the back region, and a second position, in which the back region of the glove is generally between the sleeve and the palm region, wherein the holder is adapted to be at least substantially collapsed when in the second position.

* * * * *